US009687030B2

(12) United States Patent
Bigney et al.

(10) Patent No.: US 9,687,030 B2
(45) Date of Patent: Jun. 27, 2017

(54) GARMENTS FOR MEN

(75) Inventors: Dustin Bigney, West Vancouver (CA); Shawn Robert Ellis, Kelowna, CA (US)

(73) Assignee: 0912139 B.C. LTD., North Vancouver (CA)

( * ) Notice: Subject to any disclaimer, the term of this patent is extended or adjusted under 35 U.S.C. 154(b) by 548 days.

(21) Appl. No.: 13/193,584

(22) Filed: Jul. 28, 2011
(Under 37 CFR 1.47)

(65) Prior Publication Data

US 2012/0167279 A1 Jul. 5, 2012

Related U.S. Application Data

(60) Provisional application No. 61/429,065, filed on Dec. 31, 2010.

(51) Int. Cl.
*A41B 9/02* (2006.01)

(52) U.S. Cl.
CPC ..... *A41B 9/02* (2013.01); *A41B 9/023* (2013.01)

(58) Field of Classification Search
CPC A41B 9/023; A41B 9/02; A41B 9/026; A61F 5/40
USPC ..... 2/400, 401, 403, 402, 404, 405, 78.1; 602/67
See application file for complete search history.

(56) References Cited

U.S. PATENT DOCUMENTS 2,033,551 A 3/1936 Rumery
2,140,459 A * 12/1938 Reis ..... 602/67
2,235,849 A * 3/1941 Reis ..... 2/234
2,254,863 A 9/1941 Weihe
2,310,839 A * 2/1943 Chatfield et al. ..... 602/67
2,328,953 A * 9/1943 Chatfield et al. ..... 602/67
2,438,310 A 3/1948 Ashe et al.
2,601,602 A * 6/1952 Firsching, Sr. ..... 602/67
2,623,210 A 12/1952 Chatfield
2,624,336 A 1/1953 Hansley
2,641,257 A 6/1953 Rutledge
2,652,053 A 9/1953 Dann
2,872,685 A 2/1959 Denbo
3,207,155 A 9/1965 Casey
3,220,410 A 11/1965 Sloan
3,283,545 A 11/1966 Simon
3,294,086 A 12/1966 Nelkin
3,459,181 A 8/1969 Mann
3,496,576 A 2/1970 Artzt
3,499,442 A 3/1970 Steinmetz
3,499,443 A 3/1970 Scheerer
3,511,234 A 5/1970 Larson
3,517,666 A 6/1970 Atlee
3,621,846 A 11/1971 Lehman
3,844,282 A * 10/1974 King ..... 602/67
4,009,495 A 3/1977 Faust
(Continued)

FOREIGN PATENT DOCUMENTS

CA 133058 6/2010

*Primary Examiner* — Anna Kinsaul
(74) *Attorney, Agent, or Firm* — Kilpatrick Townsend & Stockton LLP

(57) ABSTRACT

Next-to-skin garments for men include an internal stretch panel. An opening in the stretch panel receives a wearer's external genitalia. A three-dimensional pouch is defined between the stretch panel and a front portion of the body of the garment. Embodiments provide garments such as under-shorts, boarding shorts, and athletic shorts.

15 Claims, 13 Drawing Sheets

(56) References Cited

U.S. PATENT DOCUMENTS

| | | | | |
|---|---|---|---|---|
| 4,173,976 | A | 11/1979 | Bloomquist et al. | |
| 4,195,630 | A | 4/1980 | Connery et al. | |
| 4,377,008 | A | 3/1983 | Jung | |
| 4,414,971 | A | 11/1983 | Chung | |
| 4,554,685 | A | 11/1985 | Ray | |
| 4,660,551 | A | 4/1987 | Nishimura | |
| 4,702,239 | A | 10/1987 | Ichikawa | |
| 4,759,355 | A | 7/1988 | Thrower | |
| 4,870,958 | A | 10/1989 | Webster | |
| 4,955,088 | A | 9/1990 | Terjesen | |
| 5,029,345 | A | 7/1991 | Angheluta et al. | |
| 5,070,869 | A | 12/1991 | Zhang | |
| 5,157,793 | A | 10/1992 | Michels | |
| 5,226,179 | A | 7/1993 | Choi | |
| 5,237,706 | A | 8/1993 | Nalbandian | |
| 5,283,912 | A | 2/1994 | Chung | |
| 5,379,462 | A | 1/1995 | Morgan et al. | |
| 5,461,729 | A | 10/1995 | Brocks | |
| 5,524,298 | A | 6/1996 | Plunkett | |
| 5,547,466 | A | 8/1996 | McRoberts et al. | |
| 5,598,587 | A | 2/1997 | Wada | |
| 5,647,065 | A | 7/1997 | Richerson | |
| 5,718,003 | A | 2/1998 | Gwinn | |
| 5,807,299 | A | 9/1998 | McRoberts et al. | |
| 5,870,779 | A | 2/1999 | Heron | |
| 5,875,495 | A | 3/1999 | Thrower | |
| 5,978,971 | A | 11/1999 | Wald | |
| 6,026,517 | A | 2/2000 | Kang | |
| 6,038,703 | A | 3/2000 | Chung | |
| 6,061,840 | A | 5/2000 | Alligator | |
| 6,245,036 | B1 | 6/2001 | McRoberts et al. | |
| 6,289,520 | B1 | 9/2001 | Page | |
| 6,295,651 | B1 | 10/2001 | Kang | |
| 6,308,342 | B1 | 10/2001 | Qi | |
| 6,353,940 | B1 | 3/2002 | Lyden | |
| 6,487,728 | B1 | 12/2002 | Cook | |
| 6,662,378 | B2 * | 12/2003 | Vartanyan | 2/403 |
| 6,799,334 | B2 | 10/2004 | Yu | |
| 6,820,284 | B2 | 11/2004 | Horikoshi et al. | |
| 6,862,746 | B2 | 3/2005 | Cym et al. | |
| 6,901,607 | B1 | 6/2005 | Elwell | |
| D509,945 | S | 9/2005 | Ogle | |
| 7,017,193 | B2 | 3/2006 | Auger | |
| 7,024,703 | B1 | 4/2006 | Della Ratta | |
| 7,065,797 | B1 | 6/2006 | Chen | |
| 7,178,174 | B2 | 2/2007 | Soderstrom | |
| 7,198,688 | B2 | 4/2007 | Mortell et al. | |
| 7,631,369 | B2 | 12/2009 | Geiwald et al. | |
| 7,676,853 | B1 | 3/2010 | Cutlip | |
| 7,958,571 | B2 | 6/2011 | Kitsch | |
| D646,462 | S * | 10/2011 | Ellis et al. | D2/712 |
| D656,708 | S * | 4/2012 | Ellis | D2/712 |
| 8,555,422 | B2 * | 10/2013 | Steele | 2/403 |
| 2005/0229293 | A1 * | 10/2005 | Miller | 2/403 |
| 2005/0268380 | A1 | 12/2005 | Sovell | |
| 2006/0000008 | A1 | 1/2006 | Chong | |
| 2006/0005301 | A1 | 1/2006 | Taylor | |
| 2006/0162052 | A1 | 7/2006 | Stankowski et al. | |
| 2007/0180600 | A1 | 8/2007 | Allemann et al. | |
| 2007/0192941 | A1 | 8/2007 | Soderstrom | |
| 2007/0245463 | A1 | 10/2007 | Kang | |
| 2007/0277285 | A1 * | 12/2007 | Gravette et al. | 2/78.1 |
| 2008/0178368 | A1 | 7/2008 | Clark | |
| 2009/0106874 | A1 | 4/2009 | Shlush | |
| 2012/0167280 | A1 * | 7/2012 | Adams et al. | 2/403 |
| 2013/0219591 | A1 * | 8/2013 | Gu | 2/405 |

* cited by examiner

GARMENTS FOR MEN

CROSS REFERENCE TO RELATED APPLICATION

This application claims the benefit under 35 U.S.C. §119 of U.S. Patent Application No. 61/429,065 filed on 31 Dec. 2010 and entitled MEN'S GARMENT WITH POUCH AND SUPPORTING FLAP which is incorporated hereby by reference.

TECHNICAL FIELD

The invention relates to next-to-skin garments. Example embodiments of the invention include briefs, underpants, swim suits, boarding shorts, cycling shorts, and the like.

BACKGROUND

Next-to-skin clothing for men must comfortably accommodate the wearer's genitalia. Uncomfortable pressure and/or chafing of the genital area are common especially for wearers who are performing sports or other activities.

Some existing garments are described in: Angheluta et al., U.S. Pat. No. 5,029,345; Cutlip, U.S. Pat. No. 7,676,853; Shlush, US patent publication No. 2009/0106874; and Kitsch et al., U.S. patent application Ser. No. 12/000,966.

There remains a need for garments for men and boys that are more comfortable to wear than many existing garments, especially having regard to the genital area.

SUMMARY OF THE INVENTION

Aspects of the invention provide a range of garments for men and boys. The garments provide a stretch panel having an opening for receiving a wearer's genitals. A pouch is defined between the stretch panel and a front of the garment.

An example aspect of the invention provides a male garment comprising a body including a front portion and having leg openings for a wearer's legs. The body includes a crotch panel extending between the leg openings and joined to the front portion along a first seam. The crotch panel is rectangular in some embodiments. A waistband is attached at an upper edge of the body. A stretch panel is attached to the body inside the front portion. The stretch panel comprises a sheet of elastically resilient two-way stretch material having a top edge attached to the body at the waistband, a bottom edge attached at the first seam, side edges attached to the body along either side of the front portion and an opening for receiving the wearer's genitals. The opening has a rounded bottom edge and opposing side edges that are spaced apart from one another on either side of the opening. The front portion is gathered from side-to-side and top-to-bottom by the stretch panel. A three-dimensional pouch is defined between the stretch panel and the front portion.

Further aspects of the invention and features of specific embodiments of the invention are described below.

BRIEF DESCRIPTION OF THE DRAWINGS

The accompanying drawings illustrate non-limiting example embodiments of the invention.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

This invention relates to garments for men that include pouches to receive the wearer's genitalia. Such garments may provide enhanced comfort for the wearer.

Figure 1:
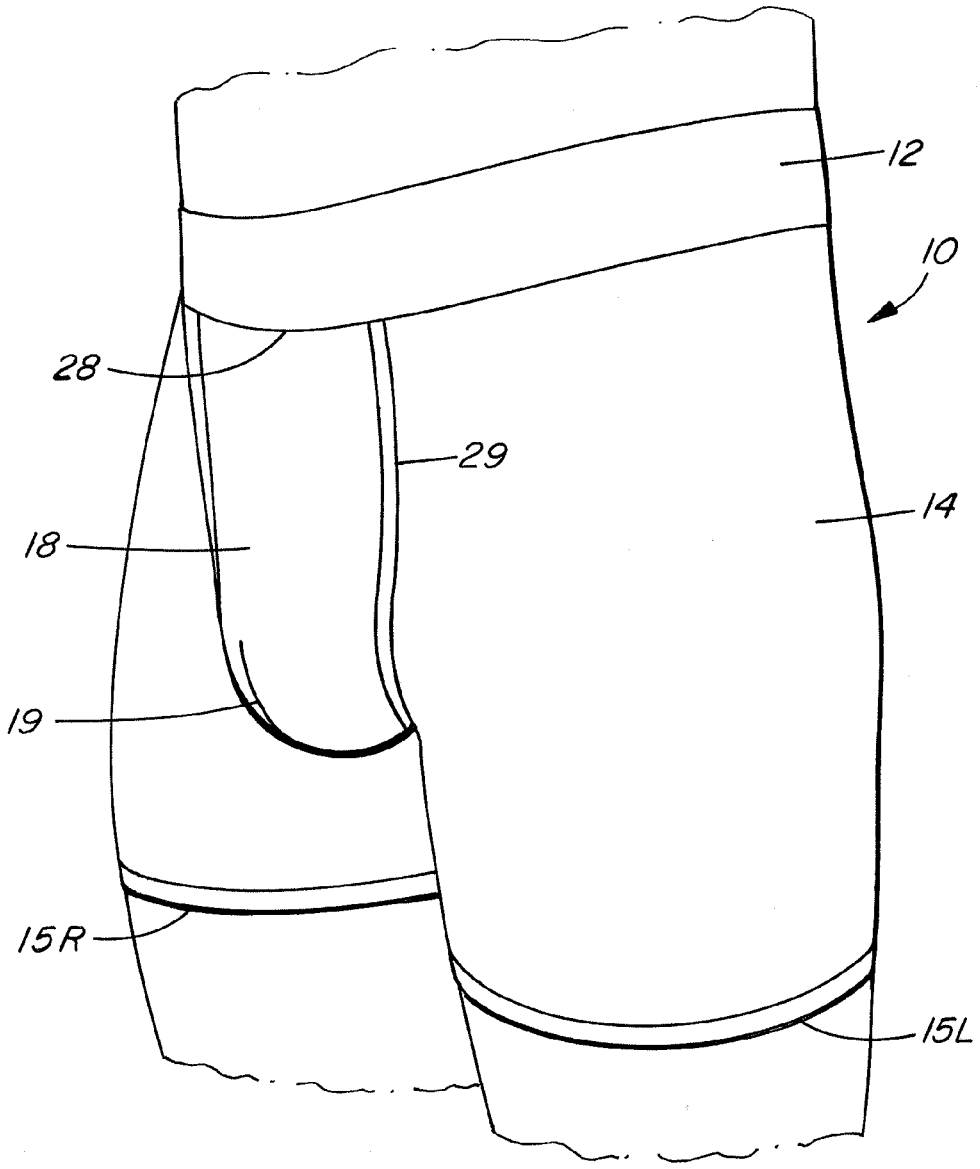
FIG. 1 is a front perspective view of a pair of undershorts according to an example embodiment.
Figure 2:
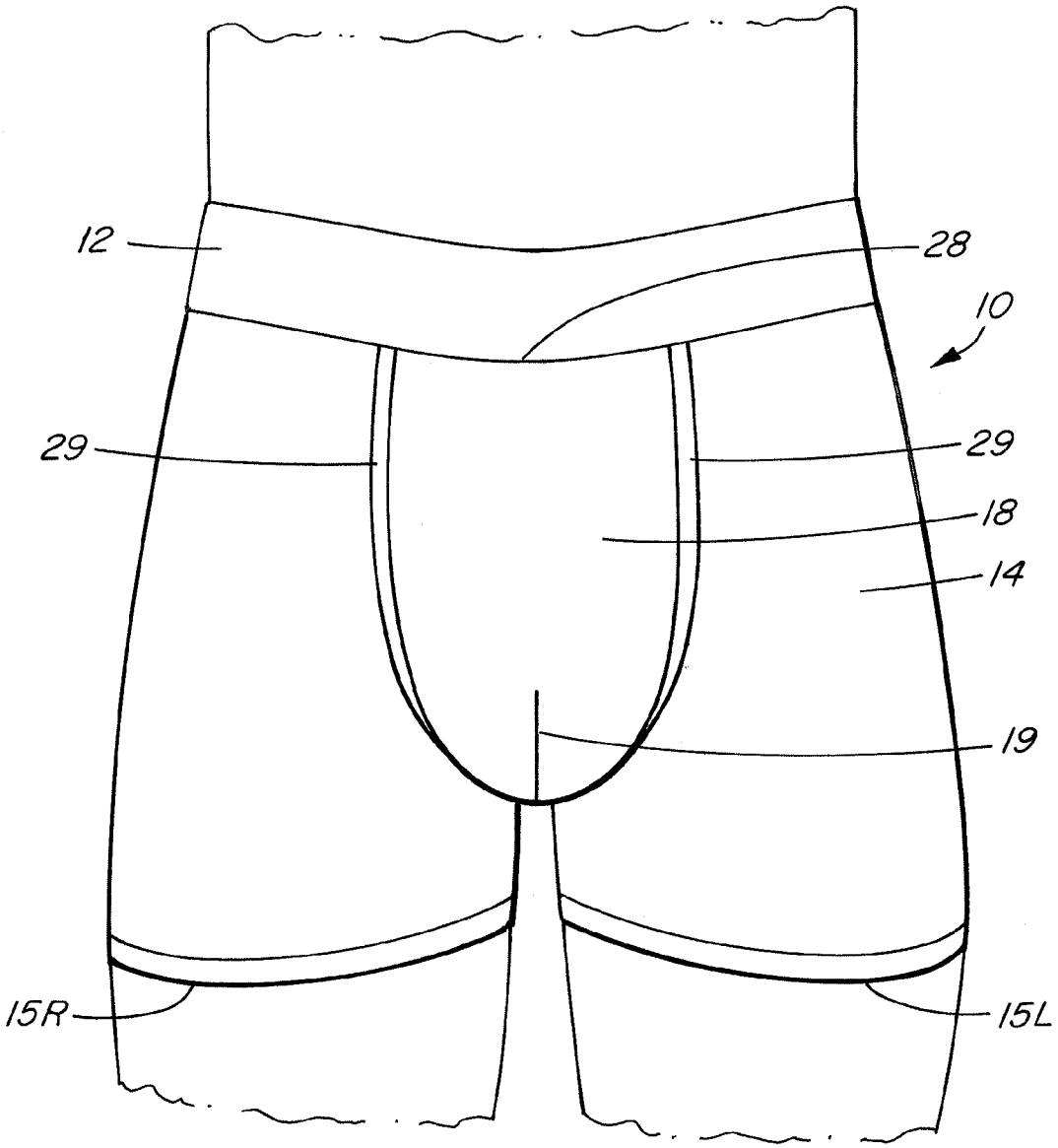
FIG. 2 is a front view of the undershorts of FIG. 1.

FIG. 1 shows undershorts 10 according to an example embodiment.

Undershorts 10 have an elastic waist band 12 supporting a fabric body 14. Body 14 extends to leg openings 15R and 15L (collectively openings 15). A front portion 18 of body 14 is shaped to include extra fabric so that front portion 18 is not pulled tightly against a wearer's body. As described below, front portion 18 forms the front part of a three-dimensional pouch 20 that receives and gently supports a wearer's genitalia. In the illustrated embodiment, front portion 18 includes a front seam or 'dart' 19 that extends part way along front portion 18 from the crotch of undershorts 10 toward waistband 12 thereby providing extra fabric in front portion 18. This adds volume to pouch 20. A tunnel opening or other suitable opening may optionally be provided in front portion 18 to permit the wearer to urinate conveniently.

Figure 3:
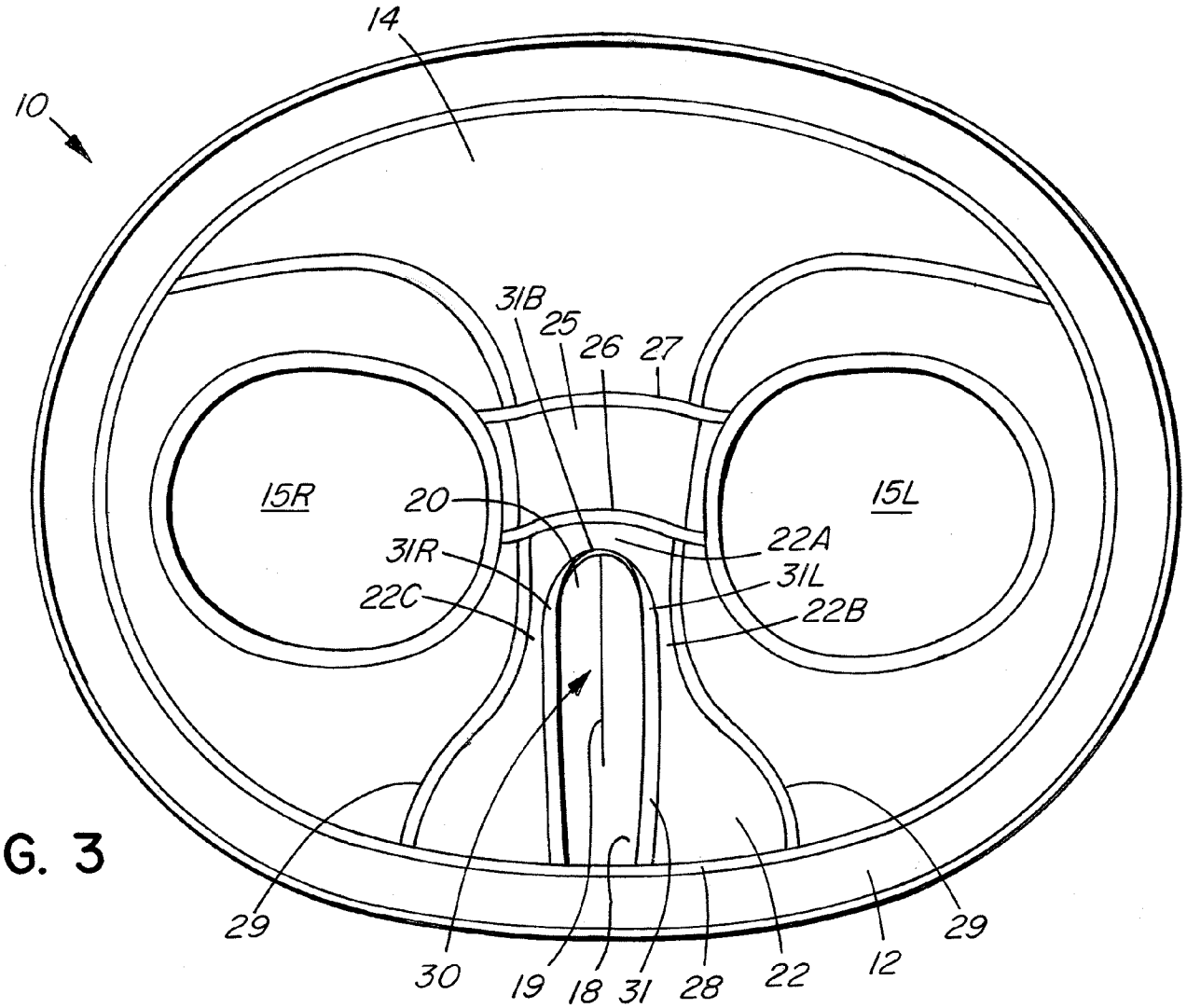
FIG. 3 is a top plan view of the undershorts of FIG. 1.
Figure 4:
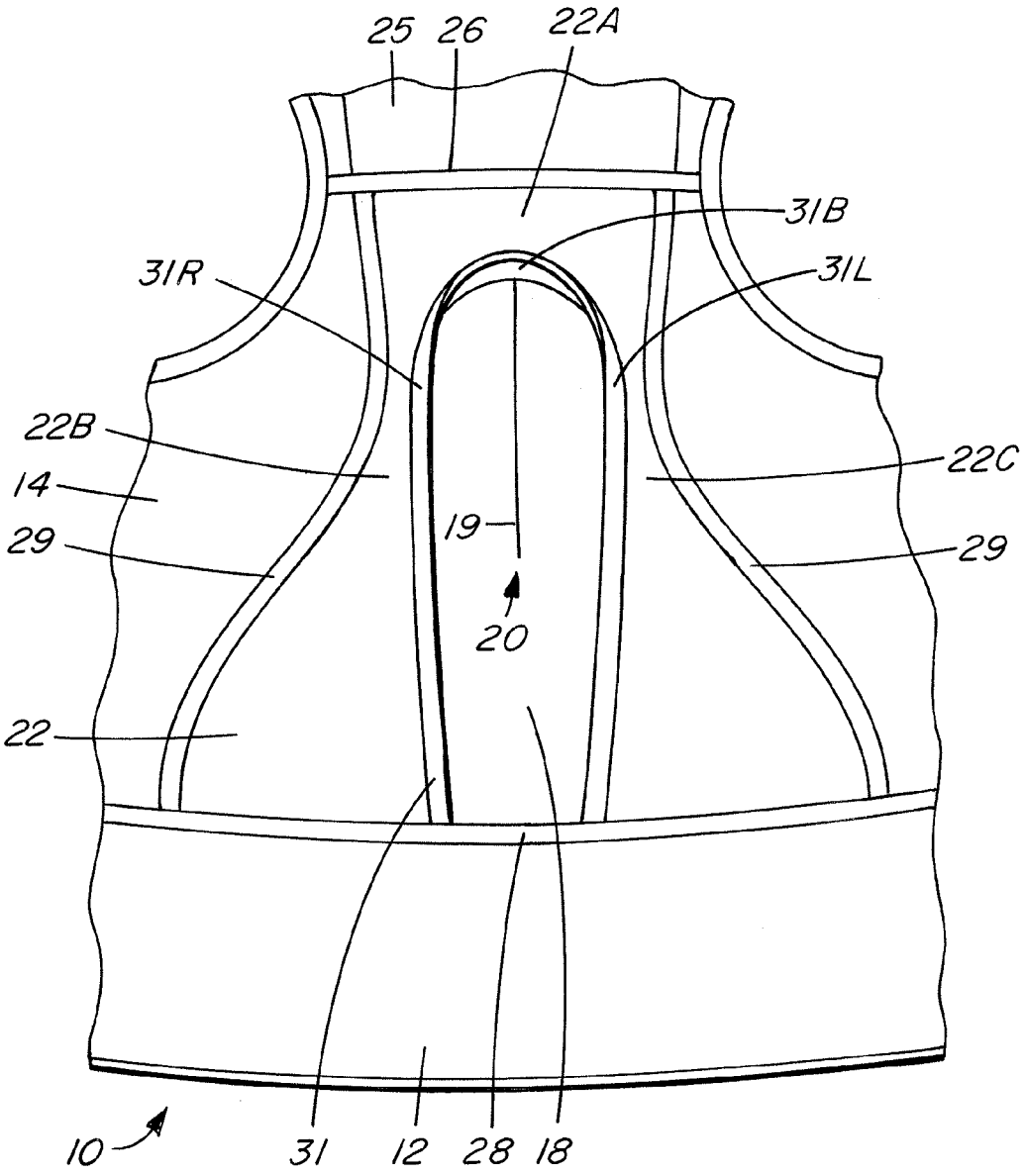
FIG. 4 is an enlarged view of the front portion of the undershorts of FIG. 1 viewed from inside.
Figure 5:
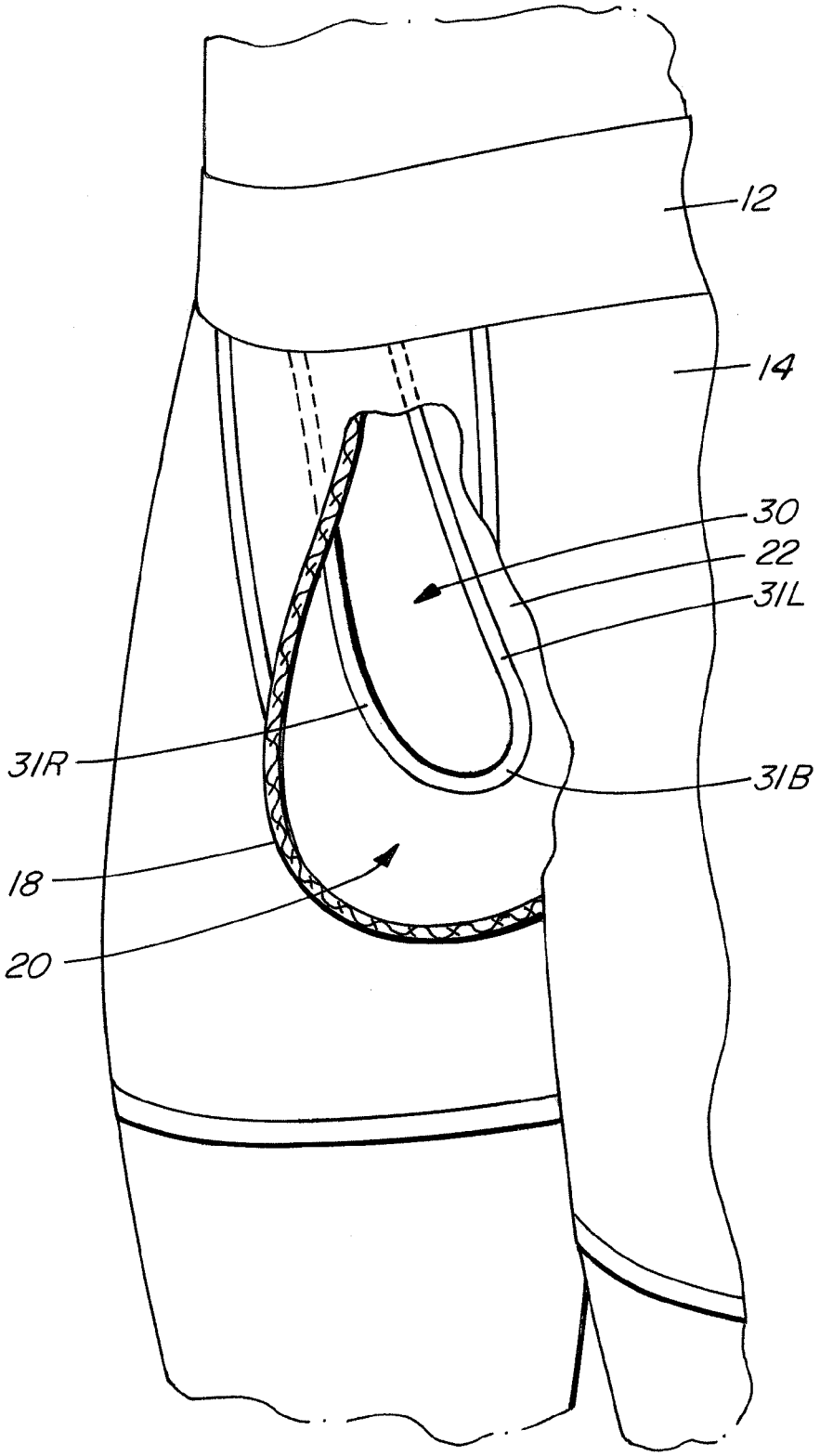
FIG. 5 is a cut-away view of the undershorts of FIG. 1 being worn.

As shown in FIG. 3, undershorts 10 include a stretch panel 22 that extends between waistband 12 and the crotch area 24 of undershorts 10. In the illustrated embodiment, undershorts 10 have a construction that includes a crotch panel 25 joined by seams 26 and 27 to the front and back sides of body 14 respectively. Crotch panel 25 is sometimes called an arc panel or moisture panel.

In this embodiment, a lower end of stretch panel 22 is attached at seam 26 and an upper end of stretch panel 22 is attached at the seam 28 joining waistband 12 to body 14. Side edges of stretch panel 22 are joined to front portion 18 of body 14 along seams 29 on either side of front portion 18.

When undershorts 10 are held open as shown for example in FIG. 3 with waistband 12 under gentle tension and body 14 hanging freely, stretch panel 22 is contracted and pulled away from front area 18 so as to provide a three-dimensional pouch 20 between stretch panel 22 and front portion 18. The bias of stretch panel 22 to be contracted more than front portion 18 helps to cause opening 30 to be held open. Pouch 20 and opening 30 may be self-aligning with the penis and scrotum of a wearer as the wearer inserts his legs through leg openings 15.

Stretch panel 22 includes an opening 30 to receive a wearer's genitalia. In the illustrated embodiment, opening 30 is U-shaped and has a softly-bound edge 31. Alternatively, stretch panel 22 may be shaped such that the free inner edges 31A and 31B along the sides of opening 30 become closer together in their parts near waistband 11 such that opening 30 is more tear-drop shaped. In yet other embodiments, the upper parts of edges 31A and 31B may be adjacent each other, or joined together such that opening 30 has an oval or elliptical shape (not shown). Regardless of the particular shape of opening 30 stretch panel 22 is configured to define opening 30 and to provide support around and underneath the scrotum of the wearer in order to comfortably position the wearer's genitals forward into pouch 20.

A soft thread is preferably used in any stitching to bind edge 31.

As can be seen in FIG. 3, holding the waistband of undershorts open as one would do to put undershorts 10 on naturally causes pouch 20 to be open to receive a wearer's genitals which can drop into place in pouch 20 through opening 30 as undershorts 10 are put on. In other words, when undershorts 10 is held by a man so as to be in a ready-to-wear position (i.e. held in mid-air by the waistband), the weight of undershorts 10 holds stretch panel 22 so that opening 30 is open and clearly defined. The man's genitals are thus naturally guided through opening 30 and positioned forward into pouch 20 as a result of this bias. As undershorts 10 are pulled on, stretch panel stretches. This bias prevents the man's genitals from falling out of pouch 20 in use, such as during physical activity and other movement.

Thus the illustrated undershorts are one example of a men's garment comprising: a waistband; a front wall depending downwardly from the waistband, a stretch panel attached behind the front wall so that the frone wall and stretch panel provide a pouch formed at a level of a mid-section of the front wall, the pouch shaped to contain a wearer's penis and scrotum when the garment is worn. The stretch panel may have a bottom portion connecting opposing side portions and may be positioned to be disposed forward of a wearer's perineum when the garment is worn. In use the wearer's scrotum may be supported underneath by the bottom portion of the stretch panel with the wearer's penis and scrotum contained in the pouch.

It can be seen that side portions 31L and 31R of edge 31 and bottom portion 31B of edge 31 are all free edges that are spaced apart from the seams at which stretch panel 22 is attached to body 14 and that front portion 18 is spaced away from these edges in the forward direction. Bottom portion 31B is preferably curved.

Side portions 31L and 31R of edge 31 are spaced apart from one another by a gap to receive the wearer's genitalia. In some embodiments the gap has a width of 2 cm or more at a location just above bottom portion 31B. In the illustrated embodiment, side portions 31L and 31R of edge 31 are generally straight.

Stretch panel 22 may be made of a two-way stretch material such that when undershorts 10 are being worn, stretch panel 22 is under gentle tension. This causes stretch panel 22 to be held gently without sagging against the wearer's body in the perineal area and in the area adjacent the wearer's inner upper thighs. Stretch panel 22 is preferably made of or faced with a soft fabric that is comfortable against a wearer's skin. Stretch panel 22 is preferably made of a breathable fabric.

When undershorts 10 are being worn, stretch panel 22 may extend between the wearer's genitalia and the inner parts of the wearer's upper thighs thereby reducing or avoiding entirely chafing between the wearer's genitalia and thighs. Similarly, stretch panel 22 may extend upwardly from underneath between the wearer's genitalia and the wearer's perineal area, thereby reducing or avoiding entirely chafing between the wearer's genitalia and perineal area. Preferably, seam 26 is positioned forward of an arc panel 25 such that the bottom portion of stretch panel 22 is located forward of the perineum of a wearer.

Figure 7:
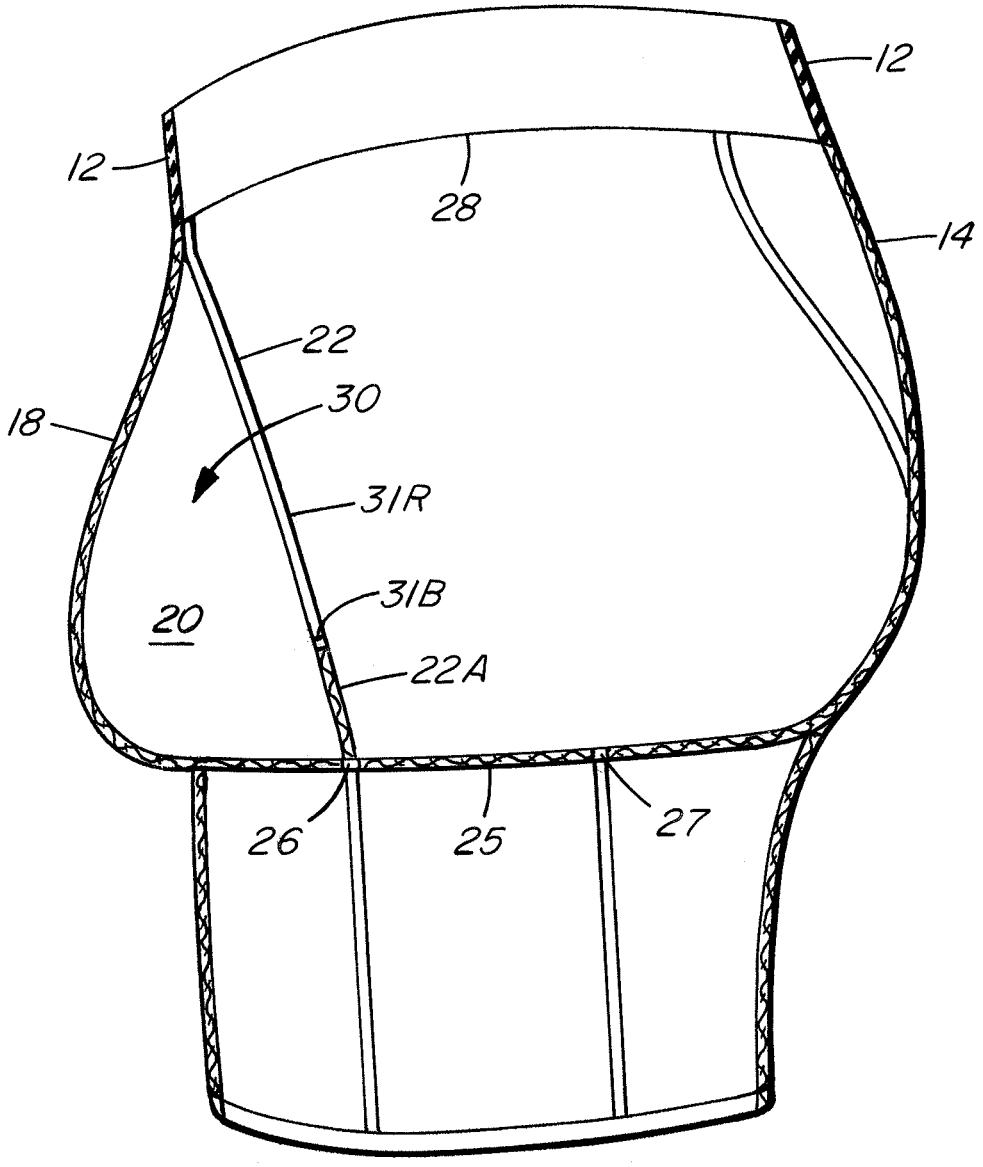
FIG. 7 is a cross-section through the undershorts of FIG. 1 hanging from the waistband.
Figure 8:
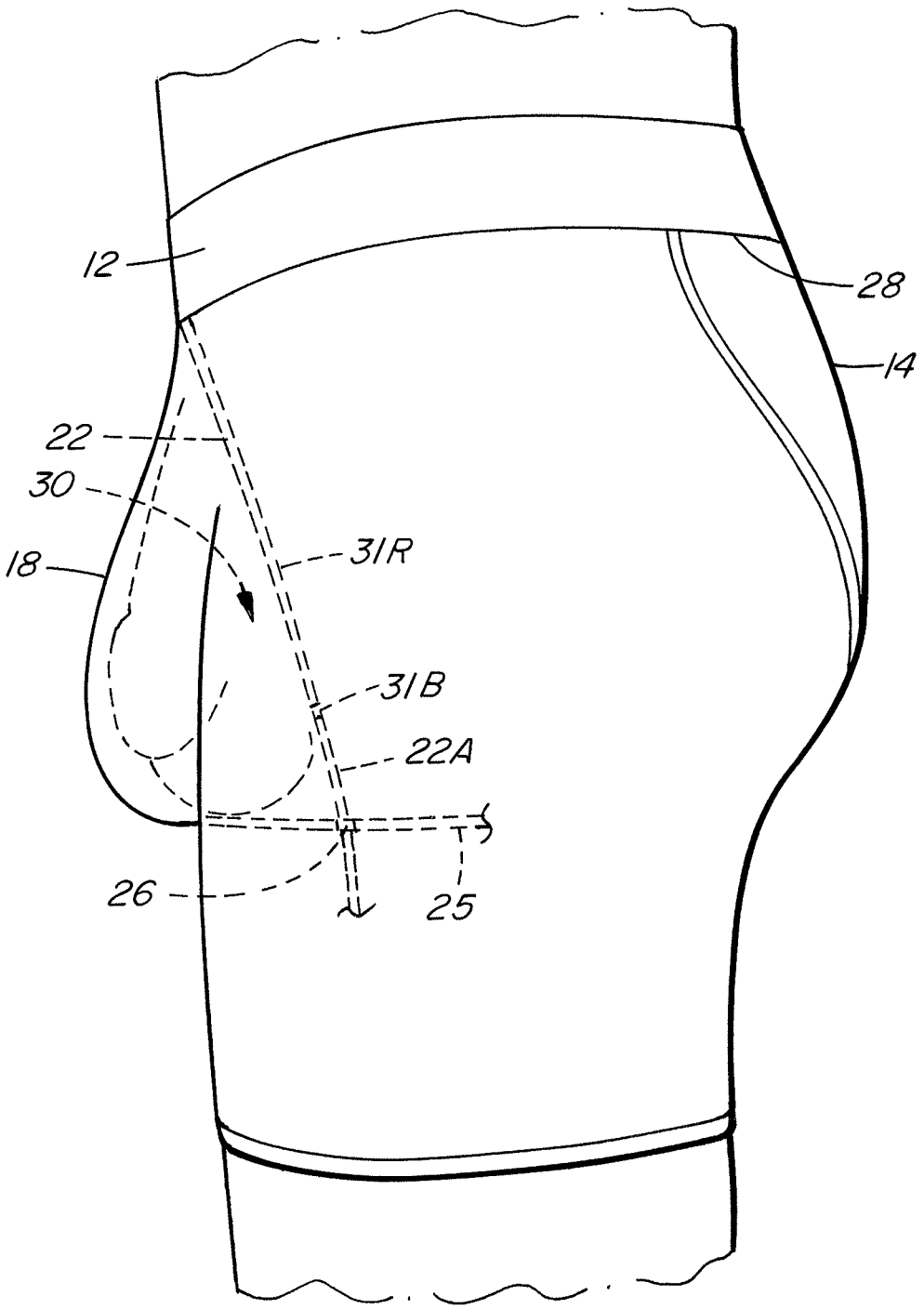
FIG. 8 is a cross-section through the undershorts of FIG. 1 being worn and showing the wearer's genitalia being supported in a pouch.
Figure 9:
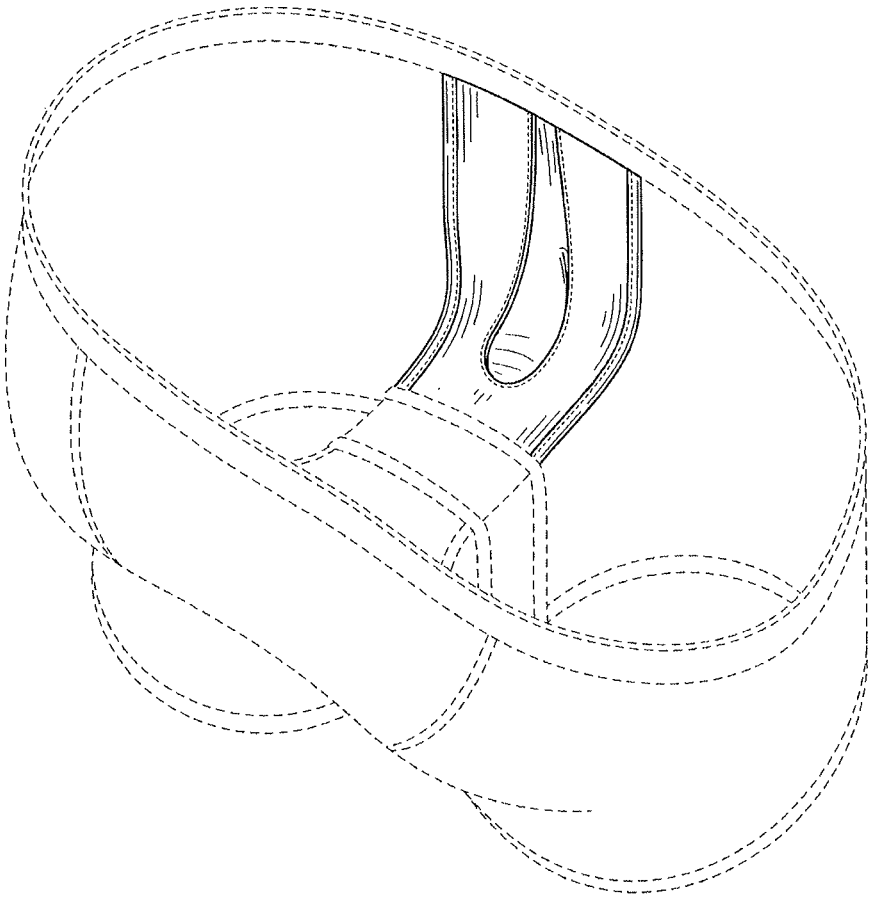
FIGS. 9 to 15 show a mens' garment according to another example embodiment.
Figure 10:
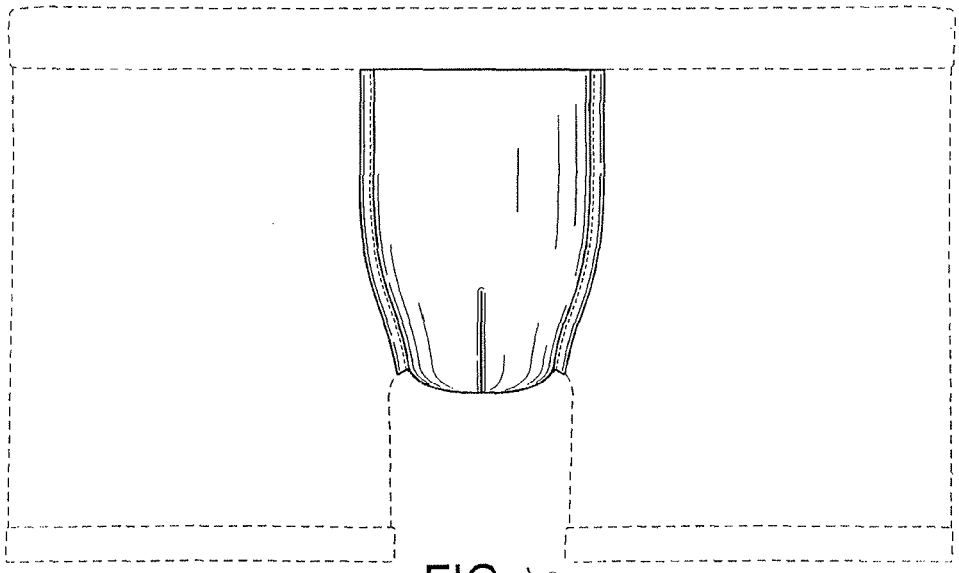
Figure 11:
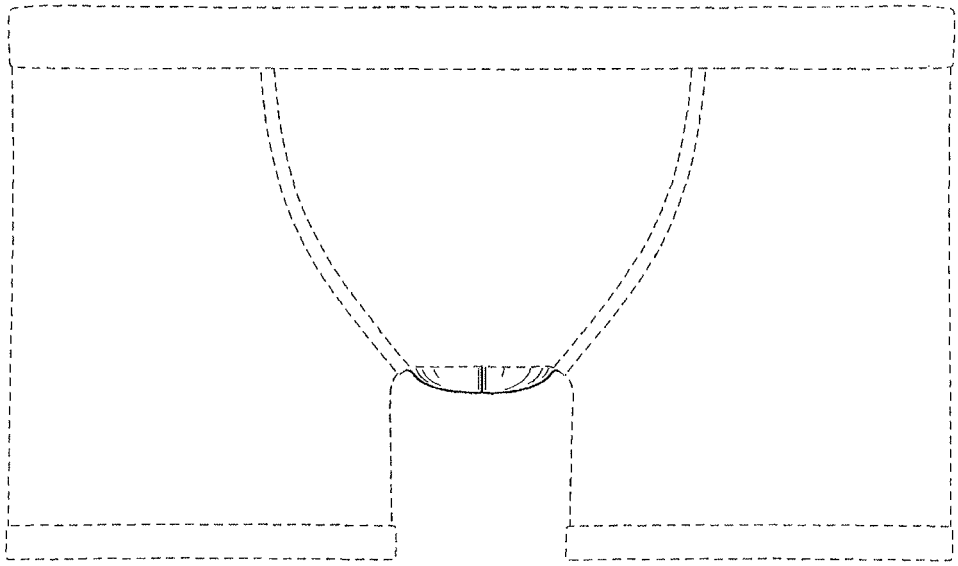
Figure 12:
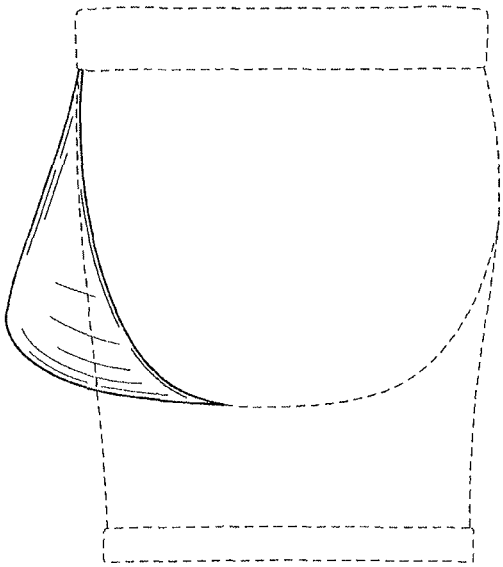
Figure 13:
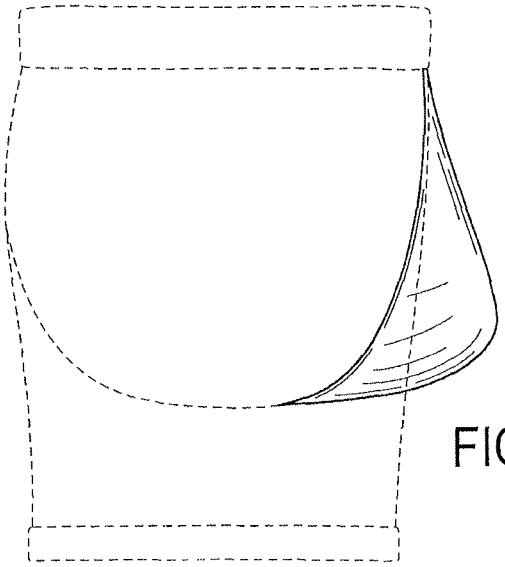
Figure 14:
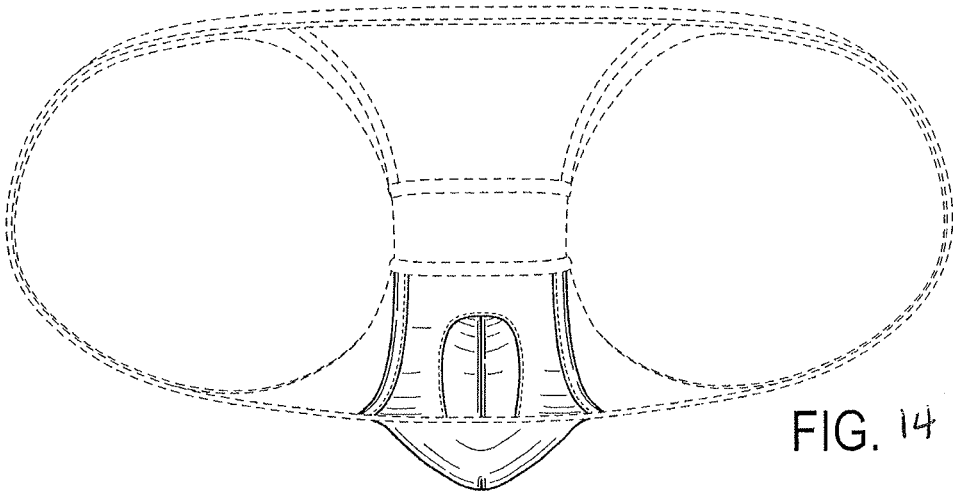
Figure 15:
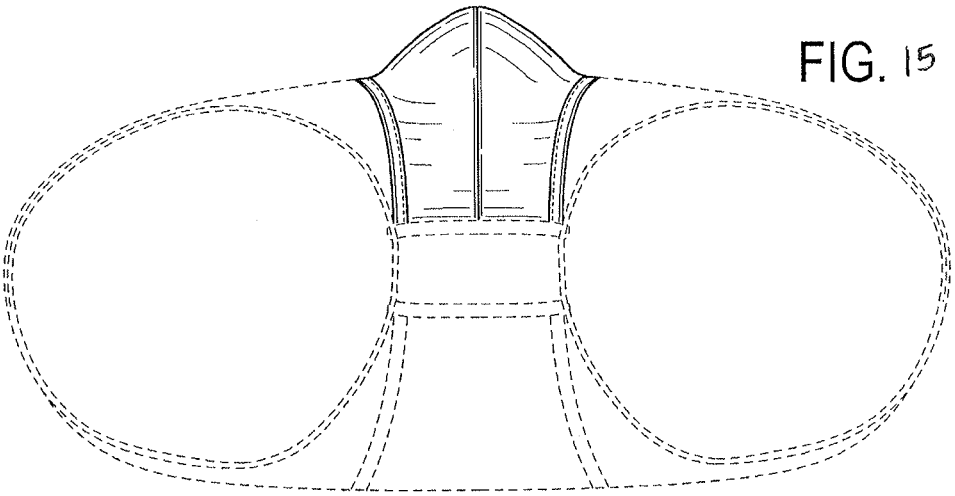

FIGS. 7 and 8 illustrate the three-dimensional nature of pouch 20. Even when undershorts 10 are being held with the waistband horizontal and body 14 hanging down from waistband 12 under its own weight, stretch panel 22 is held so that it extends away from body 14 where it is attached along seam 26. Opening 30 is naturally open to receive the wearer's genitals. The free edges 31 of opening 30 lie away from body 14. Along seam 26, stretch panel 22 forms a generally upright wall between pouch 20 and the rest of the interior of undershorts 10. The two-way elasticity of stretch panel 22 helps to gather the material of front portion 18 of body 14 to increase the volume of pouch 20.

Figure 6:
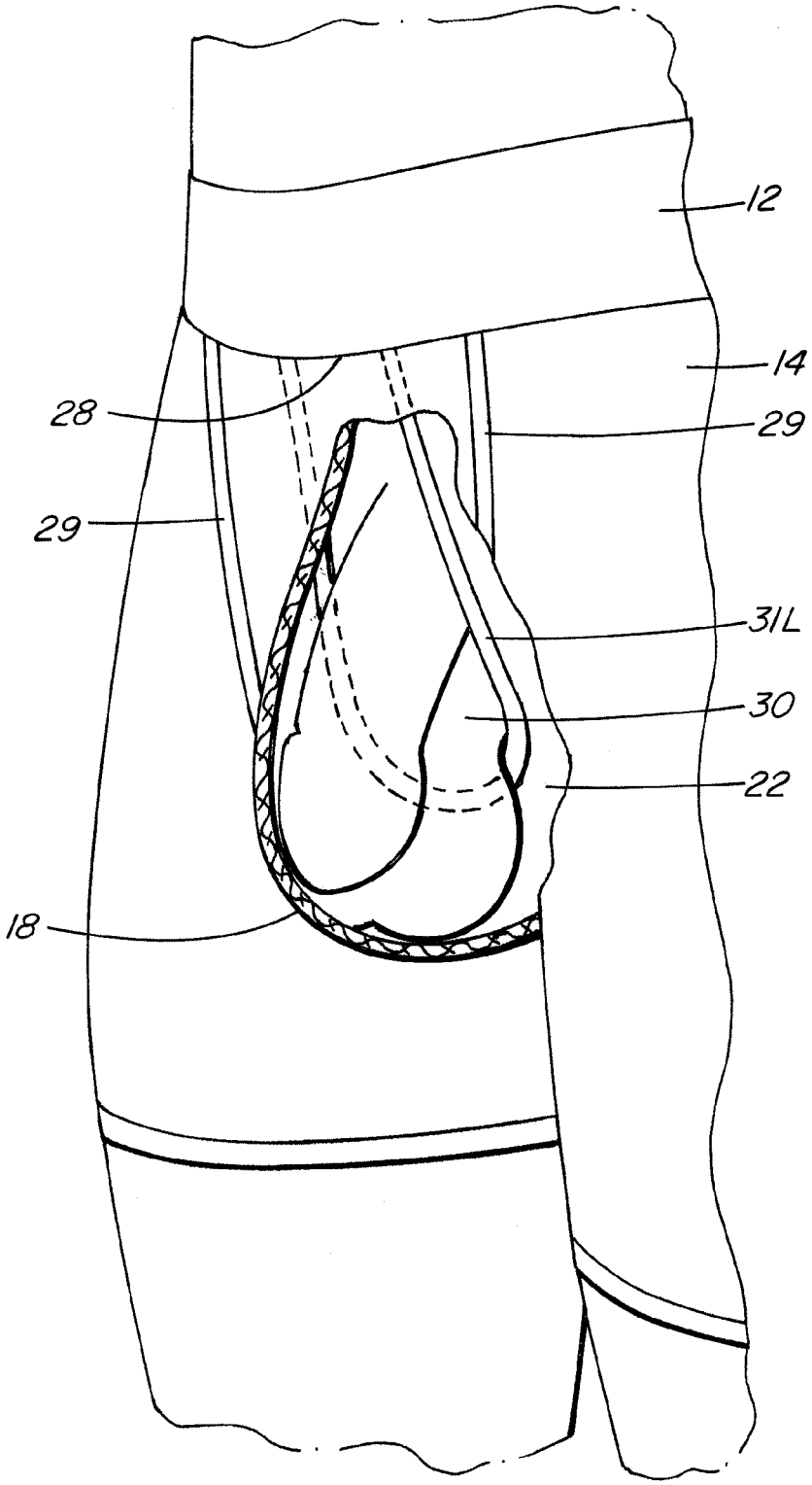
FIG. 6 is a cut-away view of the undershorts of FIG. 1 being worn and showing the wearer's genitalia being supported in a pouch.

FIG. 6 shows how, when undershorts 10 are being worn, a wearer's genitalia pass though opening 30 over the upright portion 22A of stretch panel 22 that lies directly beneath the wearer's genitalia. Portion 22A of stretch panel 22 protects the underside of the wearer's genitalia from chafing. The edge 31B along the bottom of opening 30 is gently urged upward by the elastic nature of stretch panel 22 to gently support the wearer's genitalia from below. Side portions 22B and 22C of stretch panel 22 help to suspend edge 31B. If edge portion 31B is pressed down then the elasticity of stretch panel 22, particularly side portions 22B and 22C tend to pull edge portion 31B upward toward its original position. In the illustrated embodiment, side portions 22B and 22C are generally rectangular.

Edge portions 31R and 31L gently urge against the sides of the wearer's genitalia and thereby help to counteract swinging from side-to-side during activity. In FIG. 6 it can also be seen that stretch panel 22 provides a soft layer between the wearer's genitalia and upper thighs.

In the illustrated embodiment, stretch panel 22 is generally rectangular. The length of attachment of stretch panel 22 at seams 26 and 27 is equal to within +10% or +15% for example. With undershorts 10 lying flat, face up, seams 29 are generally straight and generally perpendicular to waistband 12. The ratio of height to width of stretch panel 22 in some embodiments is approximately about 1½:1 to about 2:1. For example, in an example embodiment stretch panel 22 has an un-stretched height of about 17 cm and an un-stretched width of about 10 cm.

One advantage of embodiments in which stretch panel 22 is provided in a garment which includes a crotch panel 25 is that the seam 26 along the front side of such a crotch panel 25 provides an ideal place to attach the lower edge of stretch panel 22. As seen for example in FIG. 8, crotch panel 25 extends down the inside of a wearer's legs and, when worn, has a highest point at the wearer's crotch. The front edge of crotch panel 25 tends to be just below and behind the base of the wearer's external genitalia wile being worn. Further, the front edge of crotch panel 25 tends to be located at a location which does not receive pressure when the wearer sits. Crotch panel 25 may comprise, for example, a generally rectangular panel that extends from side-to-side from one leg opening 15 to the other.

Garments in which the lower edge of stretch panel 22 are fastened at a seam along the front edge of a crotch panel 25 are an example of a construction in which a garment comprises a perineum wall fastened at a front seam to a bottom edge of stretch panel 22, and fastened at a rear seam to a bottom edge of a rear wall part of body 14 that depends from a rear part of the waistband.

In some embodiments, the material of stretch panel 22 has asymmetrical stretch (i.e. the coefficient of elasticity of the material has a first value in a first direction in the plane of the material and a second value different from the first value in a second direction at right angles to the first direction in the plane of the material). The material may be oriented that it is easier to stretch the material of stretch panel 22 in a direction parallel to waistband 12 than it is to stretch the material in a direction perpendicular to waistband 12.

Various materials may be used for stretch panel 22. For example, stretch panel 22 may comprise an elasticized fabric. In one example embodiment the fabric comprises a cotton-Spandex™ blend. In one example embodiment the fabric comprises a woven blend of Modal™ and Spandex™. In an example embodiment, the blend comprises approximately 90% to 95% Modal™ and approximately 5% to 10% Spandex™. In another example embodiment, the blend comprises 93% Modal™ and 7% Spandex™.

The amount of stretch of a fabric may be measured in various ways. The fabric stretch may be measured by taking a strip of material that is 30-40 cm long and 20 cm wide when taught but un-stretched, anchoring one end of the strip, pulling the other end of the strip so that the material stretches and becomes elongated and determining the maximum stretched length after which the strip will no longer return to its original length in the taught but unstretched condition. The ratio of the maximum stretched length minus the taught but unstretched length to the taught but un-stretched length is the fabric stretch. For example, if the strip has a taught but un-stretched length of 25 cm and a maximum stretched length of 50 cm then the fabric stretch is (50−25)/25=100%. In some embodiments, the material of stretch panel 22 has a stretch of 30% or more. In some embodiments the material of stretch panel 22 has a stretch of at least 70% or at least 75%.

Stretch panel 22 may be pre-stretched relative to front portion 18 while it is being assembled to front portion 18 of body 14. Thus, during assembly, stretch panel 22 is substantially stretched, while front portion 16 of body 14 is not stretched or is stretched less than stretch panel 22. In some embodiments the material of stretch panel 22 is stretched by at least 50%, 55% or 60% while stretch panel 22 is being sewn in place. In an example embodiment, stretch panel 22 has a stretch of 100% and is stretched by 60% while at least the final seams which hold it in place are being sewn.

Figure 16:
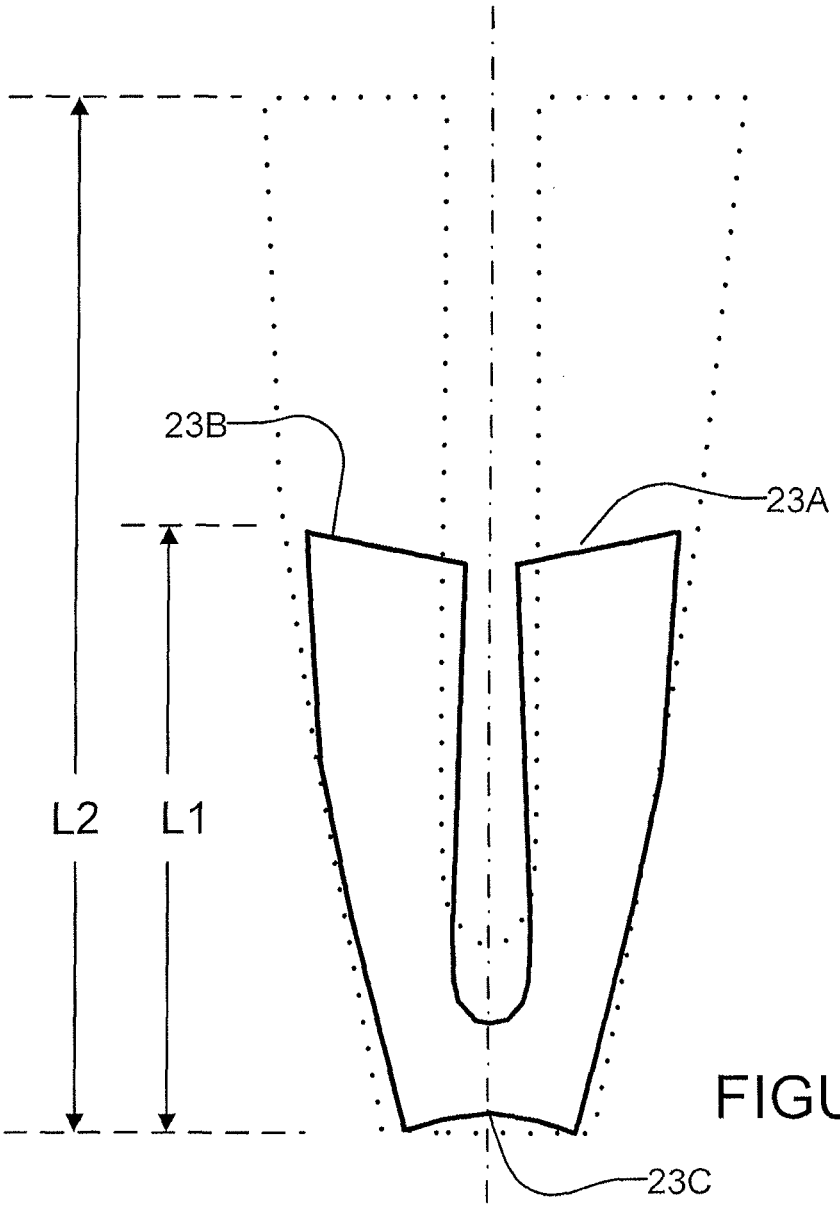
FIG. 16 shows a stretch panel before and during being sewn into a garment.

FIG. 16 shows stretch panel 22 'as cut' according to a pattern in solid outlines and 'as stretched' for assembly to front portion 18 in dashed outline. In this embodiment, top edges 23A and 23B of stretch panel 22 along which stretch panel 22 is attached at a seam parallel to waistband 12 are angled. In the illustrated embodiment, bottom edge 23C is also cut so that it is indented at the centerline. Thus, when unstretched, the cut-out material for stretch panel 22 is shorter in its vertical dimension along vertical lines extending along the edges of opening 30 than it is farther away from its centerline. As a result of the angling of edges 23A and 23B, and the indenting of bottom edge 23C, stretch panel 22 is stretched more for assembly in its portions along edge portions 31R and 31L than it is stretched in its portions closer to the sides where it is attached along seams 29. This causes the tension in stretch panel 22 when undershorts 10 are being worn or suspended to be put on to be somewhat greater along edge portions 31R and 31L than in other parts of stretch panel 22. This gradient in tension helps to better support edge portion 31B and to hold opening 30 open when undershorts 10 are being held to be put on.

As shown in dotted outline in FIG. 16, the material from stretch panel 22 may be stretched from an un-stretched length L1 to a stretched length L2 while top edges 23A and 23B and bottom edge 23C are attached along parallel seams 26 and 28 and side edges of the stretch panel 22 are attached along seams 29, for example by sewing.

After assembly, stretch panel 22 can contract. This gathers the material of front portion 18 and helps to form pouch 20 to have a three-dimensional volume open to receive a wearer's genitalia even when undershorts 10 are being suspended from waist band 12 in preparation for being put on.

The configuration of stitching used to affix stretch panel 22 to body 14 preferably permits stretching along the length of the seams. for example, in the illustrated embodiment, seams 26, 28 and 29 may be stitched using a combination of stitch pattern and/or thread that permits stretching along the lengths of seams 26, 28 and 29.

In some embodiments, stretch panel 22 is stretched in length only (i.e. in a direction perpendicular to waistband 12) as it is being attached to front portion 18 during manufacture. In some embodiments, stretch panel 22 is stretched in both width and length (four-way stretch) relative to front portion 18 as it is being attached to front portion 18 during manufacture. Thus, in its relaxed, un-stretched, configuration stretch panel 22 both pulls side edges of front portion 18 toward one another at seams 29 and pulls top and bottom edges of front portion 18 toward one another at seams 26 and 28. This, builds volume in pouch 20 especially when taken in combination with the shaping of front portion 18 (e.g. by front seam 19) which makes from portion 18 non-flat.

In some embodiments a length measured along material of the front portion 18 from seam 26 to waistband 12 exceeds a length measured along the fabric of stretch panel 22, when un-stretched by at least 50%. In some embodiments a length measured along material of the front portion 18 side-to-side at the level of bottom portion 31B from seam 28 to seam 29 exceeds a length measured along the fabric of stretch panel 22, when un-stretched between the same seams by 10 to 15% or more.

In some embodiments, the shaping of front portion 18 is such that with stretch panel 22 held horizontally under just enough tension such that stretch panel 22 is generally planar with front portion 18 hanging below stretch panel 22, the center part of front portion 18 hangs well below the plane of stretch panel 22. In some embodiments, the center part of front portion 18 hangs below the plane of stretch panel 22 by a distance of 3 cm or more when undershorts 10 are held in this test configuration.

Like all clothing, undershorts 10 may be made to fit different sizes of men and boys and may be made from different fabrics to suit different personal preferences and price points. Thus, individual dimensions are not critical.

In some embodiments, the distance A along stretch panel 22 from the point at which it joins body 14 to the lowest point along the edge of opening 30 is at least 2 cm. In some embodiments, this distance is in the range of about 2 cm to about 3 cm. In some embodiments, the horizontal distance B between opposed edges of opening 30 when undershorts 10 or other garments according to some example embodiments are not being worn but are being suspended as shown for example in FIG. 3, distance B is in the range of about 3 cm to about 6 cm. In some embodiments, the horizontal distance C along stretch panel 22 from the point at which it joins body 14 (e.g. at seam 29) to the edge 31R or 31L of opening 30 just above bottom portion 31B is at least 2 cm. In some embodiments, this distance is in the range of about 2 cm to about 5 cm. In some embodiments, the distance D along the fabric in the center of front portion of body 18 from the lower edge of waist band 12 to the point where stretch panel 22 attaches to body 14 (e.g. seam 26) is at least 15 cm. In some embodiments, this distance is in the range of about 15 cm to about 25 cm.

It can be appreciated that garments which incorporate a stretch panel as shown in the accompanying drawings may be formed such that they are self-aligning with a wearer's genitalia, allowing the garment to be put on by a wearer without the wearer having to manually hold or position the pouch to receive his genitals. A stretch panel structured and incorporated as illustrated in the accompanying drawings can support and position a wearer's the scrotum and penis away from both the wearer's thighs and perineum. The scrotum and penis may therefore be protected from pinching between the thighs or being sat upon, thereby enhancing comfort of the wearer.

The invention may be applied to any next-to-skin below-the waist garments for men. For example, the principles discussed above may be applied to shorts, swim suits, boarding shorts, briefs, boxer shorts, surf shorts, cycling shorts, unitards, long underwear, sports uniforms, athletic supporters, fighting shorts, pyjamas, and other next-to-skin garments for males.

Except where otherwise indicated or necessarily implied, the description herein uses relative directional terms such as front, back, above, below, top, bottom, upper, lower, right and left relative to a wearer wearing a garment as described and standing upright.

Where a component (e.g. a panel, seam, elastic, thread, opening, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

As will be apparent to those skilled in the art in the light of the foregoing disclosure, many alterations and modifications are possible in the practice of this invention without departing from the spirit or scope thereof. For example:

It is not mandatory that stretch panel 22 be free from openings. In some embodiments, stretch panel 22 comprises a continuous layer of material with no openings other than opening 30. In other embodiments, stretch panel 22 may have one or more openings around the periphery of opening 30.

It is not mandatory that the material of stretch panel 22 be different from the material(s) of the rest of body 14. In some embodiments different fabrics are used for stretch panel 22 and for the front portion 18 of body 14.

Stretch panel 22 may incorporate openings into pouch 20 that are of various shapes. Example openings are U-shaped (as described above), oval, elliptical, tear-drop shaped or the like.

Stretch panel 22 may optionally be formed from a plurality of pieces of fabric seamed together. For example, stretch panel 22 may be formed from three pieces of fabric, two of which extend vertically along sides of opening 30 and one of which extends transversely across the bottom of opening 30.

It is not mandatory that the garment include a body that covers a wearer's buttocks. In some embodiments, constructions as described herein are applied to athletic supporters (jock straps). In general, a pouch as described herein may be embodied in various types of men's garments, particularly in a mid-section of a front wall of men's garments to be worn around a man's torso.

Accordingly, the scope of the invention is to be construed in accordance with the substance defined by the following claims.

What is claimed is:

1. A male garment comprising:

a body including a front portion and having leg openings for a wearer's legs, the body including a crotch panel extending between the leg openings and joined to the front portion along a first seam;

a waistband attached by a waistband seam at an upper edge of the body; a stretch panel attached to the body inside the front portion, the stretch panel comprising a sheet of elastically resilient four-way stretch material having a top edge attached to the body at the waistband seam, a bottom edge attached at the first seam, side edges attached to the body at side seams extending substantially continuously along either side of the front portion from the first seam to the waistband seam and an opening for receiving a wearer's genitals, the opening having a rounded bottom edge and opposing side edges that are spaced apart from one another on either side of the opening;

the stretch panel being resiliently elastic both in a direction between the top edge and the bottom edge and in a direction between the side edges, the stretch panel having a length when unstretched smaller than a length measured along the front portion between the first seam and the waistband seam and a width when unstretched smaller than a width measured along the front portion between the side seams such that the front portion is gathered from side-to-side and top-to-bottom by the stretch panel and defines a three-dimensional pouch between the stretch panel and the front portion for receiving the wearer's genitals and holding the wearer's genitals while the garment is being worn.

2. A garment according to claim 1 wherein the stretch panel has asymmetrical stretch characteristics such that the stretch panel stretches more easily in a direction parallel to the waistband and less easily in a direction at right angles to the waistband.

3. A garment according to claim 1 wherein the stretch panel is rectangular and the opening is U-shaped.

4. A garment according to claim 3 wherein the stretch panel comprises a fabric having a stretch of at least 30%.

5. A garment according to claim 1 wherein the length measured along material of the front portion from the first seam to the waistband seam exceeds a length measured along the fabric of the stretch panel when unstretched, by at least 30%.

6. A garment according to claim 1 wherein the garment is a pair of undershorts.

7. A garment according to claim 1 wherein the stretch panel comprises a fabric different from a fabric of the body.

8. A garment according to claim 1 wherein the opening has a width in excess of 2 cm.

9. A garment according to claim 1 wherein: the front portion depends downwardly from the waistband and the front portion is formed to provide the pouch at a mid-section thereof; the stretch panel is positioned to be disposed forward of a wearer's perineum when the garment is worn, whereby, in use, a scrotum of a wearer of the garment is supported underneath by the stretch panel to contain a wearer's penis and scrotum in the pouch.

10. A garment according to claim 1, wherein the elastically resilient four-way stretch material is comprised of a spandex blend.

11. A garment according to claim 1, wherein the stretch panel is fastened to the front portion while in a pre-stretched condition while the front portion is less stretched, whereby the stretch panel is biased to hold the opening open while the garment is held in position to be put on.

12. A garment according to claim 1, wherein the first seam is disposed forward of a perineum region of a wearer.

13. A garment according to claim 1 wherein the opening has a U-shape when the stretch panel is in a relaxed state.

14. A garment according to claim 1 wherein the stretch panel is formed from a single unitary piece of woven fabric.

15. A garment according to claim 1 wherein the pouch comprises a dart seam stitched along a bottom portion of the pouch and substantially centrally to provide extra volume in front of and underneath the genitals of a wearer.

* * * * *